US010577855B2

(12) United States Patent
Shloznikov et al.

(10) Patent No.: US 10,577,855 B2
(45) Date of Patent: Mar. 3, 2020

(54) GLAZING PROFILES WITH SEAMLESS APPEARANCE AND METHOD OF USE

(71) Applicant: KLIL INDUSTRIES LTD., Karmiel (IL)

(72) Inventors: Alona Shloznikov, Karmiel (IL); Robi Gal, Kiriat-Motzkin (IL)

(73) Assignee: KLIL INDUSTRIES LTD, Karmiel (IL)

( * ) Notice: Subject to any disclaimer, the term of this patent is extended or adjusted under 35 U.S.C. 154(b) by 0 days.

(21) Appl. No.: 16/077,128

(22) PCT Filed: Feb. 9, 2017

(86) PCT No.: PCT/IL2017/050164
§ 371 (c)(1),
(2) Date: Aug. 10, 2018

(87) PCT Pub. No.: WO2017/137993
PCT Pub. Date: Aug. 17, 2017

(65) Prior Publication Data

US 2019/0032393 A1 Jan. 31, 2019

(30) Foreign Application Priority Data

Feb. 11, 2016 (IL) ..... 244083

(51) Int. Cl.
*E06B 3/54* (2006.01)
*E06B 3/58* (2006.01)

(52) U.S. Cl.
CPC ..... *E06B 3/5454* (2013.01); *E06B 3/54* (2013.01); *E06B 3/58* (2013.01); *E06B 3/5821* (2013.01)

(58) Field of Classification Search
CPC ..... E06B 3/60; E06B 3/549; E06B 3/5821; E06B 3/5871; E06B 3/24; E06B 2003/6226; E06B 1/40; E06B 1/18
See application file for complete search history.

(56) References Cited

U.S. PATENT DOCUMENTS 3,155,205 A * 11/1964 Piace ..... E06B 3/5821 52/204.591
3,455,080 A * 7/1969 Meadows ..... E06B 3/549 52/204.597

(Continued)

FOREIGN PATENT DOCUMENTS

| | | |
|---|---|---|
| DE | 102009017735 | 12/2010 |
| EP | 0733764 | 9/1996 |
| WO | WO 99/49167 | 9/1999 |

OTHER PUBLICATIONS

European Search Report for Application No. EP17749982.9, dated Aug. 16, 2019.

*Primary Examiner* — Gisele D Ford
(74) *Attorney, Agent, or Firm* — Pearl Cohen Zedek Latzer Baratz LLP

(57) ABSTRACT

A glazing frame assembly comprises glazing frame base profile that has cross section which comprises elongated spinal element, glass support element and glazing bar connection unit. The glazing bar connection unit comprises snap support arm, lean support jag and top end. The glazing frame also comprises glazing bar profile that has a cross section which comprises bar spinal element and snap hook element. The top end element protrudes away from the spinal element beyond the lean support jag by at least the thickness of the bar spinal element.

7 Claims, 13 Drawing Sheets

(56) References Cited

U.S. PATENT DOCUMENTS

| | | | | | |
|---|---|---|---|---|---|
| 3,691,713 | A * | 9/1972 | Dulaney | E06B 3/5821 | 52/204.591 |
| 4,524,978 | A * | 6/1985 | Mauser | E06B 3/305 | 277/637 |
| 4,612,743 | A * | 9/1986 | Salzer | E06B 3/28 | 49/501 |
| 5,138,811 | A * | 8/1992 | Parrott | E06B 3/5821 | 52/204.591 |
| 5,768,837 | A * | 6/1998 | Sjoholm | E06B 3/305 | 52/204.62 |
| 6,318,037 | B1 * | 11/2001 | Hansen | E06B 1/30 | 52/204.54 |
| 8,621,793 | B2 * | 1/2014 | Abdul Lathief | E06B 3/5821 | 52/204.53 |
| 2004/0231255 | A1 * | 11/2004 | Silverman | E06B 3/24 | 52/204.6 |
| 2005/0034386 | A1 * | 2/2005 | Crandell | E06B 3/24 | 52/204.5 |
| 2005/0055906 | A1 * | 3/2005 | Barnard | E06B 3/5892 | 52/204.1 |
| 2014/0318050 | A1 * | 10/2014 | Lathief | E06B 3/66304 | 52/204.595 |
| 2015/0184684 | A1 * | 7/2015 | Lathief | E06B 3/549 | 403/330 |
| 2018/0128035 | A1 * | 5/2018 | Kim | A47G 1/06 | |

* cited by examiner

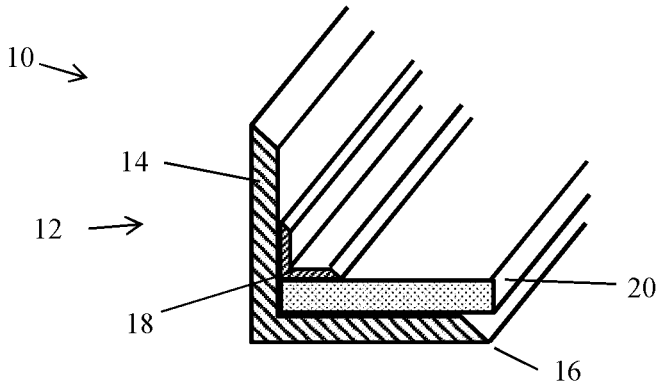
Fig. 1A PRIOR ART
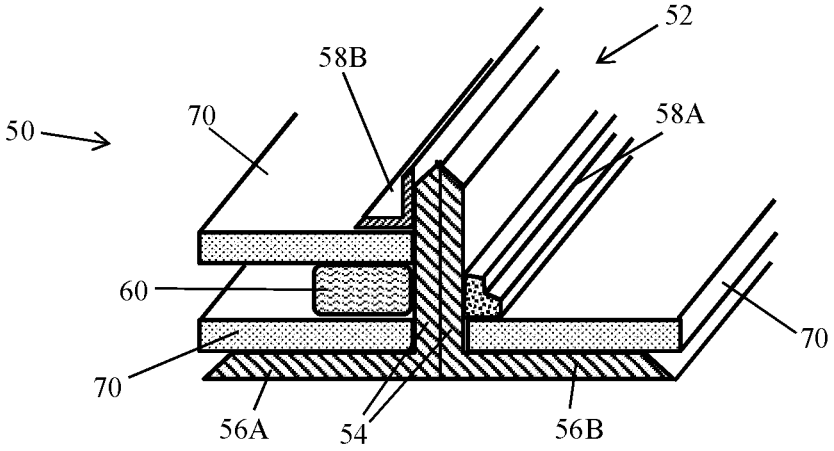
Fig. 1B – PRIOR ART

3E

GLAZING PROFILES WITH SEAMLESS APPEARANCE AND METHOD OF USE

CROSS-REFERENCE TO RELATED APPLICATIONS

This application is a National Phase Application of PCT International Application No. PCT/IL2017/050164, International Filing Date Feb. 9, 2017, entitled "Glazing Profiles with Seamless Appearance and Method of Use", published on Aug. 17, 2017 as International Patent Publication No. WO 2017/013993, claiming the benefit of Israel Patent Application No. 244083, filed Feb. 11, 2016, which is hereby incorporated by reference.

BACKGROUND OF THE INVENTION

Glazing support structures (GS S) are widely used in internal and external constructions and may be found in large variety of forms and in different methods of installations. Glazing is widely used for constructing internal and external walls and windows. There is an ongoing effort to provide glazing structures that compose fancy look with stronger support while employing less material in the support structure per length unit of the structure. In general, as is depicted in FIGS. 1A and 1B, a structure for glazing may be adapted for supporting glaze plate(s) disposed along one side of the support structure, or on both sides of it. It may be adapted to support one layer of glazing, or more layers/glazing plates. Generally GSS, such as GSS 10 or 50, comprises a main support element or profile, such as elements 12 or 52, which are adapted to provide structural support for the supported glaze plates 20 or 70, so as to stabilize them when installed vertically, horizontally or in any desired inclined angle. Element 20, 70 may comprise main support structure 14, 54 and glaze support leg 16, 56. GSS 10, 50 further comprise glazing bar 18, 58 adapted to provide tightening pressure onto glaze plate 20, 70 against support leg 16, 56. In some embodiments glazing bar may be replaced by glazing bond-and-seal material which is adapted to provide both tightening action of glaze plate 20, 70 towards structure leg 16, 56 and sealing against water/air/dust between glaze plate 20, 70 and main support structure 14, 54.

In some embodiments the GSS may be designed to support glaze plates on both sides as is shown in FIG. 1B. In such case GSS 50 has two support legs 56A and 56B, disposed on opposite sides of main support structure 54. Such GSS may be useful for glazing of large framed with internal partitions. GSS such as 10 or 50 may be used for glazing single glass, double glass or tripe glass. For example, the left side of GSS 50 in FIG. 1B presents glazing of two glasses 70, where one glass lies on structure leg 56A, then a spaced 60 (for example made of rubber or other flexible material capable of providing sealing) and then second glass 70 is placed on spacer 60 which is clamped towards first glass 70 by glazing bar 58B. Glazing bars such as bars 18, 58A and 58B may be firmly clamped onto the respective glass using one or more of known means and methods.

FIGS. 2A and 2B schematically present means and method for clamping glass onto glazing support structure 100. Structure 100 comprise main support structure 102A and glaze support legs 102B, extending substantially perpendicular to main support structure 102A1. Glass plates 110 may be placed on glaze support legs 102B and be clamped to glaze support legs by glazing bars 104, which are formed as 'right-angled' bar adapted to be placed leaning onto main support structure 102A and firmly attached onto glass plate 110 using, for example, bolts 106, rivets 106, or the like. Some decorative features of this type of glazing are attributed to the thin appearance of the thin face 102A1 of the main support structure, which is seen from a viewpoint looking perpendicularly to the glazing. It is considered to provide elegant and retro-style look to the glazing structure.

One line of GSS that gained high popularity is the thin-face type of profiles (also known is the iron-style profiles, also known as "Belgian profiles"), which has relatively thin facet on the face of the profile seen to a viewer standing in front of the window.

SUMMARY OF THE INVENTION

A glazing frame assembly is disclosed comprising a glazing frame base profile and a glazing bar profile. The cross section of glazing frame base profile comprising an elongated spinal element and glazing bar connection unit. The cross section of the glazing frame base profile comprising an elongated spinal element, a glass support element. The glazing bar connection unit comprising a snap support arm, a lean support jag and a top end of said spinal element. The cross section of the glazing bar profile comprising a bar spinal element, a snap lean protrusion and a snap hook element, wherein the top end element protrudes away from the spinal element beyond the lean support jag by $D_{PROT}$ at least the by the thickness of the bar spinal element.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

FIGS. 1A and 1B depict structure for glazing may be adapted for supporting glaze plate(s) disposed along one side of the support structure;

Figure 2A:
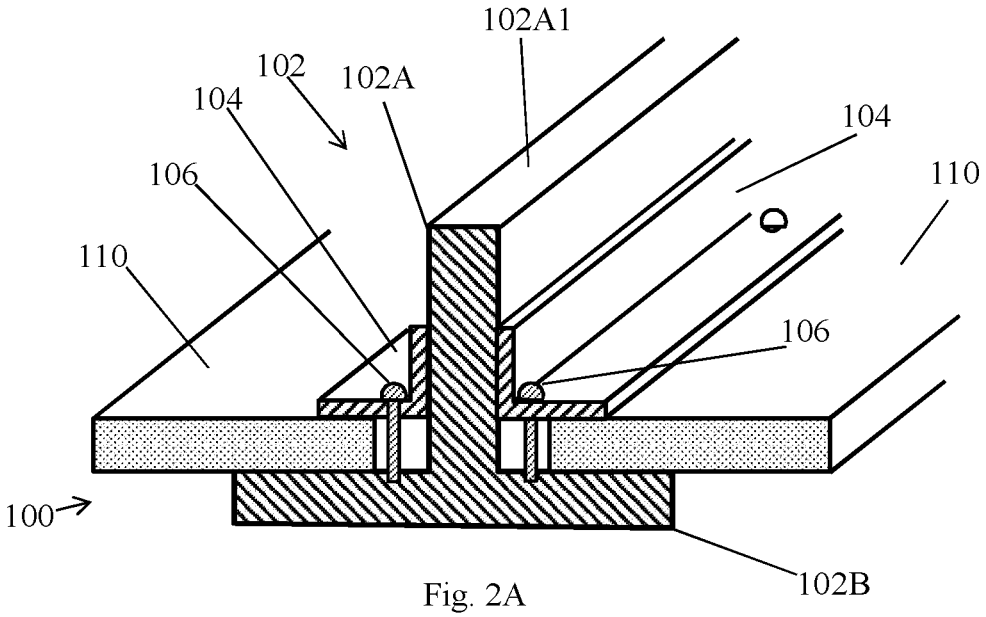
Fig. 2A PRIOR ART
FIGS. 2A and 2B schematically present means and method for clamping glass onto glazing support structure.
Figure 2B:
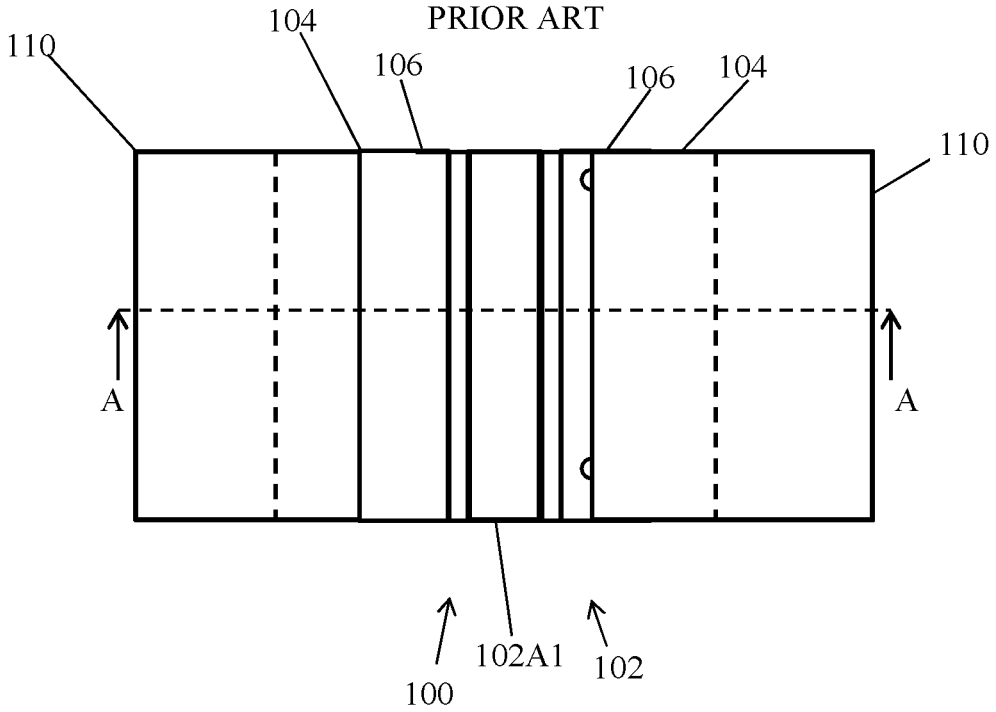
Fig. 2B PRIOR ART

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The desirable look provided by glazing structures such as the glazing structures used for Belgian style glazing described above with regard to FIGS. 1A-1B, 2A-2B, required lengthy and expensive blacksmith work while fast building constructing could not afford these disadvantages. Cheaper and faster to construct solutions were found using pre-fabricated aluminum profiles designed to provide both the required supporting strength and the typical look of thin face facing the viewer standing in front of the glasses.

Figure 3A:
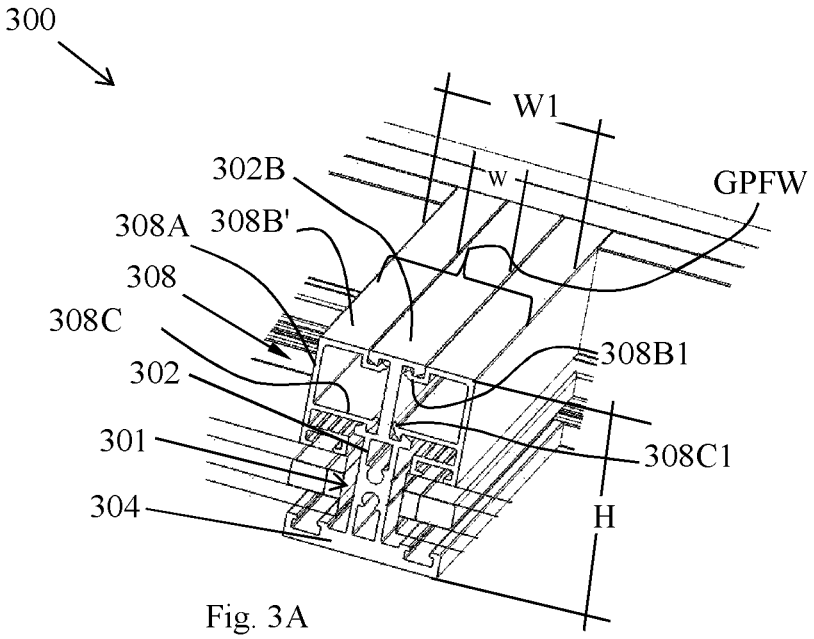
Fig. 3A PRIOR ART
FIGS. 3A and 3B, schematically present a perspective view of thin face profile glazing structure and a cross section view of this structure, as known in the art.
Figure 3B:
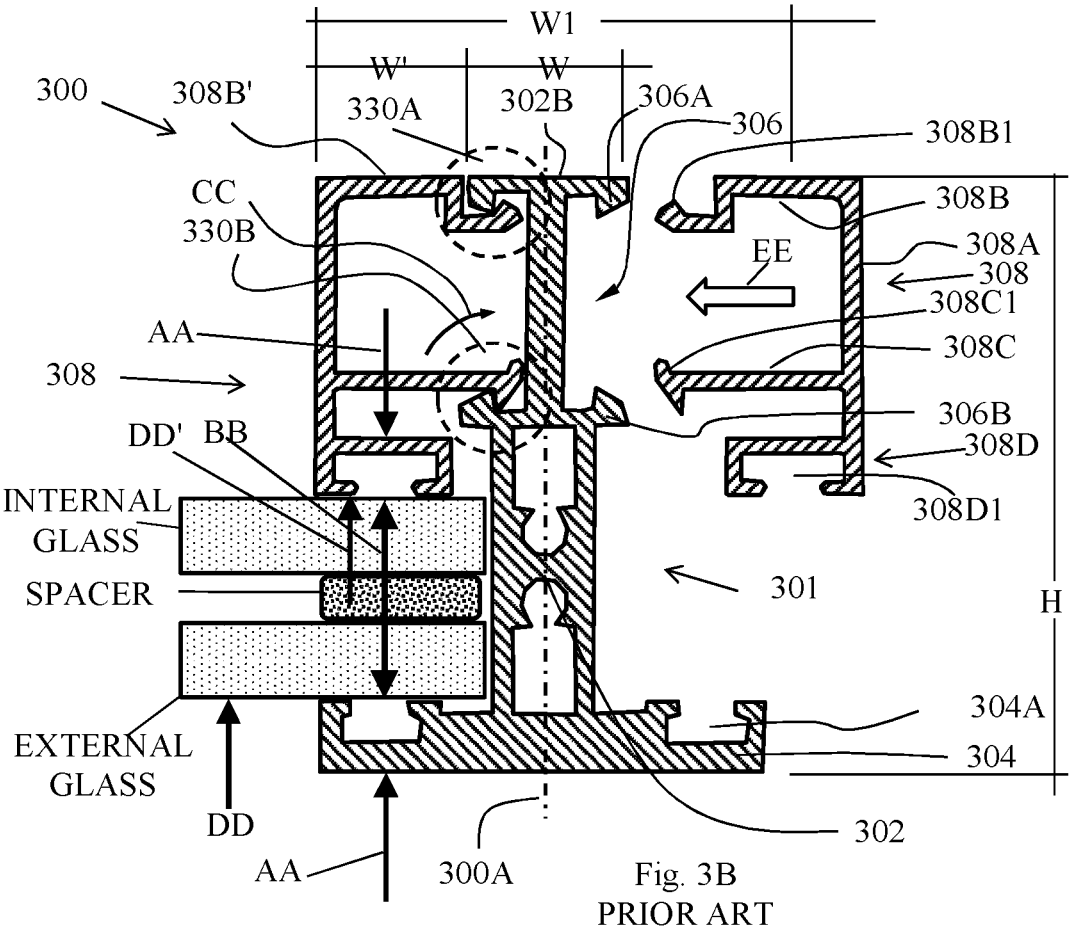
Fig. 3B PRIOR ART

Reference is made to FIGS. 3A and 3B, which schematically present a perspective view of thin face profile glazing structure 300 and a cross section view of this structure, as known in the art. Glazing structure 300 comprises main support profile 301 which comprises main structure profile 302 and glass support portion 304. Main structure profile 302 has a thin cross section with its height dimension H (the dimension parallel to symmetric line 300A in FIG. 3B) bigger than the width dimension W. The actual magnitude of the H dimension is typically set to ensure sufficient structural support for the glass plates. Main structure profile 302 is adapted to provide structural support especially to forces acting perpendicular to the supported glass, and as such acting through its plane parallel to the symmetric line 300A (or to the dimension H in general) and therefore receiving maximal support from the profile. Glass support portion 304 may be disposed proximal to or at a first end of main structure profile 302 and may extend traversal to it. Glass support portion 304 is designed to provide support to one side of the glass assembly. Glass support portion 304 may be an integral part of main structure profile 302 or may be firmly attached to it. Glazing structure 300 further comprises glazing bar 308 adapted to provide counter pressure onto the glass assembly against the support provided by glass support portion 304. Glazing bar 308 is typically made of a profile separated from main structure profile 302 and is typically formed so as to enable connection to main structure profile 302 while providing installation pressure onto the glass assembly.

Main structure profile 302 may have disposed at its second end, opposite to the first end of main structure profile 302, glazing bar installation structure 306, which comprises at least two protrusions 306A and 306B, formed as two snap-on jags protruding sideways from main structure profile 302 and having each sharpened point pointing at each other and adapted to accommodate corresponding snap-on jags of glazing bar 308. The distance between the at least two protrusions 306A and 306B may be adapted to provide universal installation channel 306, for accommodating assemblies such as locking assembly, hinge assembly, and the like.

Glazing bar profile 308 may comprise main longitudinal portion 308A adapted to be parallel to main structure profile 302 when installed onto it. Main longitudinal portion 308A may have disposed at its first end first installation snap arm 308B having at its distal end sharpened point 308B1. Main longitudinal portion 308A may have disposed closer to its second end second installation snap arm 308C having at its distal end sharpened point 308C1. Sharpened points 308B1 and 308C1 point away from each other and the distance between them is slightly longer than the distance between the sharpened points of protrusions 306A and 306B, thus allow snap-on connection of glazing bar profile 308 onto protrusions 306A and 306B. Main longitudinal portion 308A may have further disposed at its distal end counter pressure end 308D, adapted to provide counter pressure onto glass assembly structured with profile glazing structure 300 when snap-attached to main structure profile 302.

When glazing bar profile 308 is snapped onto main structure profile 302 the distance between the outer face of counter pressure end 308D of glazing bar profile 308 and the side of glass support portion 304 of main support profile 301 facing counter pressure end 308D is designed to accommodate the desired number of glass plates and the desired number and thickness of respective spacers disposed between them.

As may be seen on the left side of FIG. 3B when glass assembly, of two glass plates and a spacer disposed between them, is assembled between glass support portion 304 and the outer face of counter pressure end 308D of glazing bar profile 308, pressure aligned with arrows AA is asserted onto the glass assembly, which in turn returns counter force as depicted by arrow BB onto glass support portion 304 and the outer face of counter pressure end 308D. The exertion of force BB on glazing bar profile 308 produces moment CC around pivot point formed at the contact point of sharpened point 308C1 of second installation snap arm 308C with the sharpened point of protrusion 306B, as encircled in dash-line circle 330B. the action of moment CC is directed as indicated by the arrow head of the arrow CC. When glass assembly that is assembled in glazing structure 300 is subject to increased forces acting perpendicular to the face of the glass plate(s), for example due to wind pressure exerted onto the glass assembly, increased force as indicated by arrow DD may be forced onto the glass assembly and therefore exerts additional force DD' onto glazing bar profile 308 in the direction indicated by arrow DD'.

The installation of glazing using glazing structure 300 involves forming installation frame made of main support profiles 301, insertion of glass assembly into the formed flame, and firmly fastening the glass assembly by insertion of glazing bar profile 308 onto main support profile 301 in the direction indicated by arrow EE and finally snapping it on protrusions 306A and 306B. Typically, the outer face of counter pressure end 308D of glazing bar profile 308 may be equipped with elastic profile accommodated in channel 308D1, in order to provide soft contact with the glass assembly. Similarly an elastic profile may be accommodated in channel 304A of arm 304, in order to provide soft and elastic contact with the glass assembly.

Figure 3C:
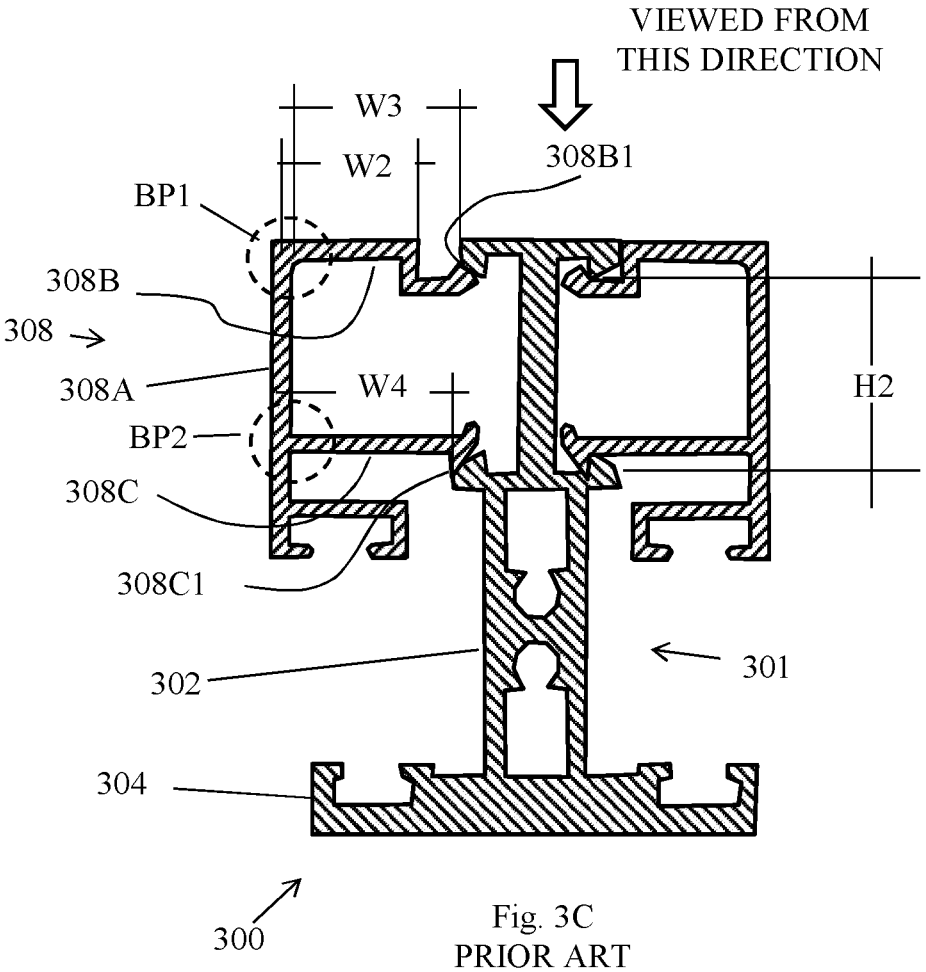
Fig. 3C PRIOR ART
FIGS. 3C and 3D schematically present cross section view and a partial top view, respectively, of glazing profile structure.
Figure 3D:
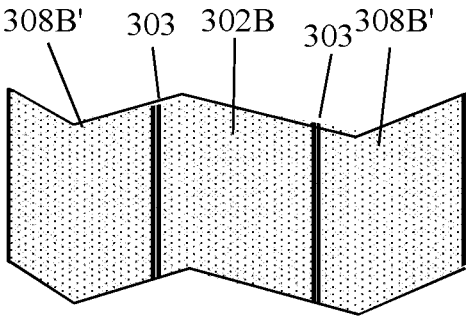
Fig. 3D PRIOR ART

When increased force, such as force presented by arrow DD', is exerted onto glazing bar profile 308, for example due to wind force exerted onto the glass assembly, at a certain point the effect of the increased exerted force may cause first installation snap arm 308B and second installation snap arm 308C to bend towards each other and as a result the snap-engagements encircled in circles 330A and 330B depart, and first installation snap arm 308B and second installation snap arm 308C are pulled out from the counter-snap arrangement of snap jags 306A and 306B, as described in details with respect to FIG. 3C and FIG. 3D.

Figure 3E:
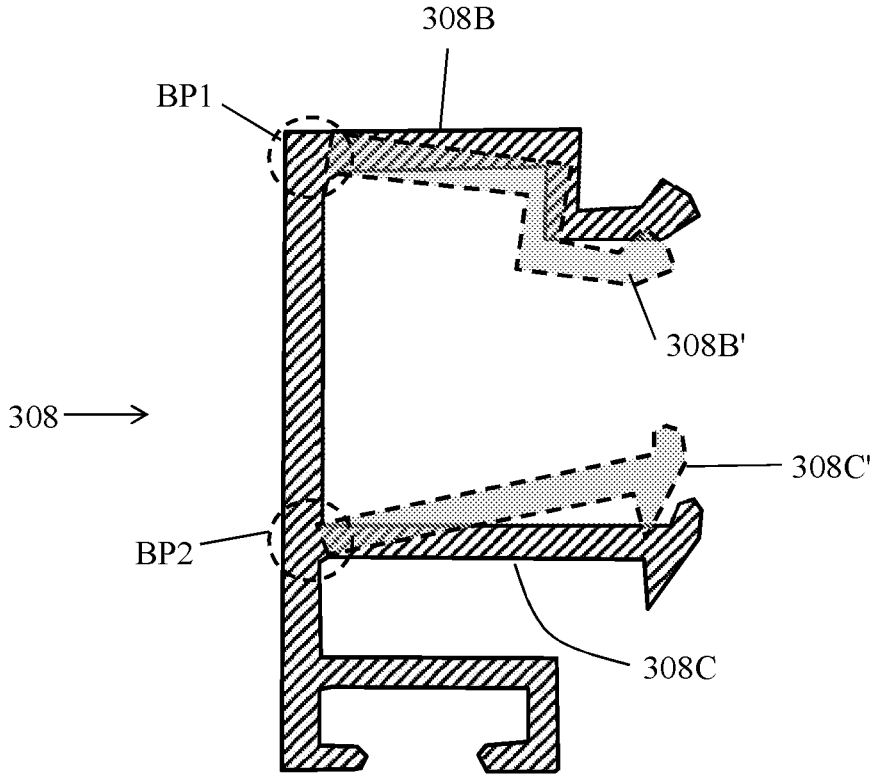
Fig. 3E PRIOR ART
FIG. 3E depicts schematic cross section of a glazing bar undergoing forced pulled-out bending.

Reference is made now to FIGS. 3C and 3D which schematically present cross section view and a partial top view, respectively, of glazing profile structure 300 with the left glazing bar 308 positioned out of main support profile 301. Reference is also made to FIG. 3E which depicts schematic cross section of glazing bar 308 undergoing forced pulled-out bending. As seen in FIG. 3C, the connection point of first installation snap arm 308B to main longitudinal portion 308A of glazing bar 308, marked BP1, may act as a pivot point for bending of first installation snap arm 308B when pull-out force is exerted. Similarly, bending point BP2 may act as a pivot for the bending of second installation snap arm 308C when pull-out force is exerted. It will be apparent to one skilled in the art that the longer is the distance W3 between first sharpened point 308B1 and bending point BP1, and the distance W4 between second sharpened point 308C1 and bending point BP2, the smaller is the pull-out force required to depart glazing bar 308 from its snapped position in main support profile 301. In other words, the bigger is the ratio between W3 and the distance H2 between first sharpened point 308B1 and second sharpened point 308C1, or the ration between W4 and H2, the smaller is the pull-out force required to cause undesired pulling of glazing bar 308 from main support profile 301. FIG. 3D depicts the way first and second installation snap arms are bent (depicted in dashed lines) under exertion of pull-out force.

Further, as seen in FIG. 3A, the total width of the face of the glazing structure 300, seen to a viewer looking straight at the glass and marked Glazing Profile Face Width (GPFW), is the sum of width W of the face 302B of main structure profile 302 and twice the width W' of portion 308B' of first installation snap arm 308B:

$$GPFW=W+2W'$$

There is a need to shorten the length of portion 308B' for at least two reasons, as discussed above. First, the sorter this portion is, the bigger is the pull-out force required to disengage the glazing bar from the main structure profile, that is—the bigger is the resistance of the structure to forces acting on the glazing, such as wind forces. Second, as the length W' gets shorter, the appearance of the glazing structure is considered nicer and more desirable.

The right side glazing bar 308 of FIG. 3B depicts the action involved in installation of the glazing. After the required number of glass plates and separation spacers are disposed (as seen at the left side of FIG. 3B), glazing bar 308 may be manually, on spot of the installation, be slid over the face of the upper glass towards the respective sharpened points of protrusions 306A and 306B, as depicted by arrow EE. Typically, since the snap-engagement arrangement includes two pairs of snap-on connecting points, the force required to be operated parallel to the direction of arrow EE for engaging glazing bar 308 with main structure profile 302, is quite high and when the installation length of the glazing structure is long, for example longer than 1.5 meters, more than one installation worker may be required to complete the process, and/or—use of installation hammer may be required. There is a need to provide glazing bars that require less exerted installation force while providing improved resistance to pull-out forces, such as wind forces.

Figure 4A:
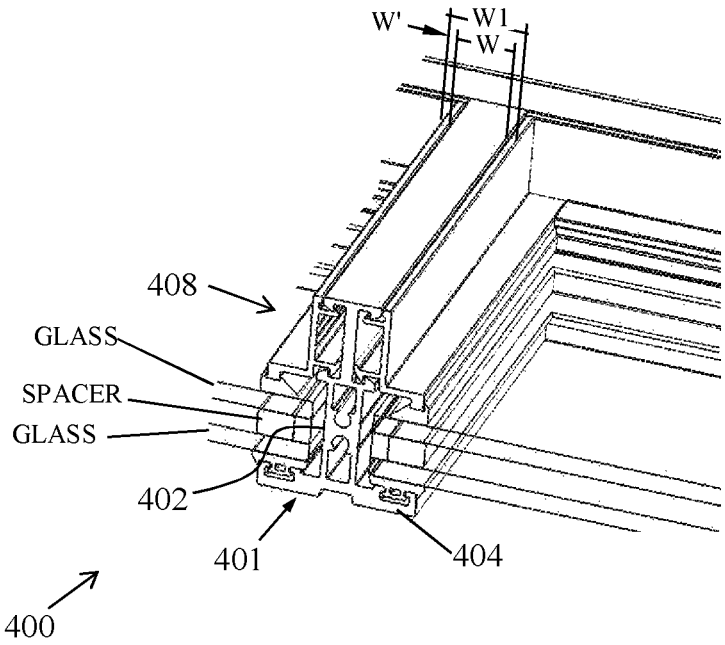
Fig. 4A PRIOR ART
FIGS. 4A-4D schematically present a perspective view of thin face profile glazing structure, a cross section view, a partial disassembled view and a partial top view of this structure, as known in the art.
Figure 4B:
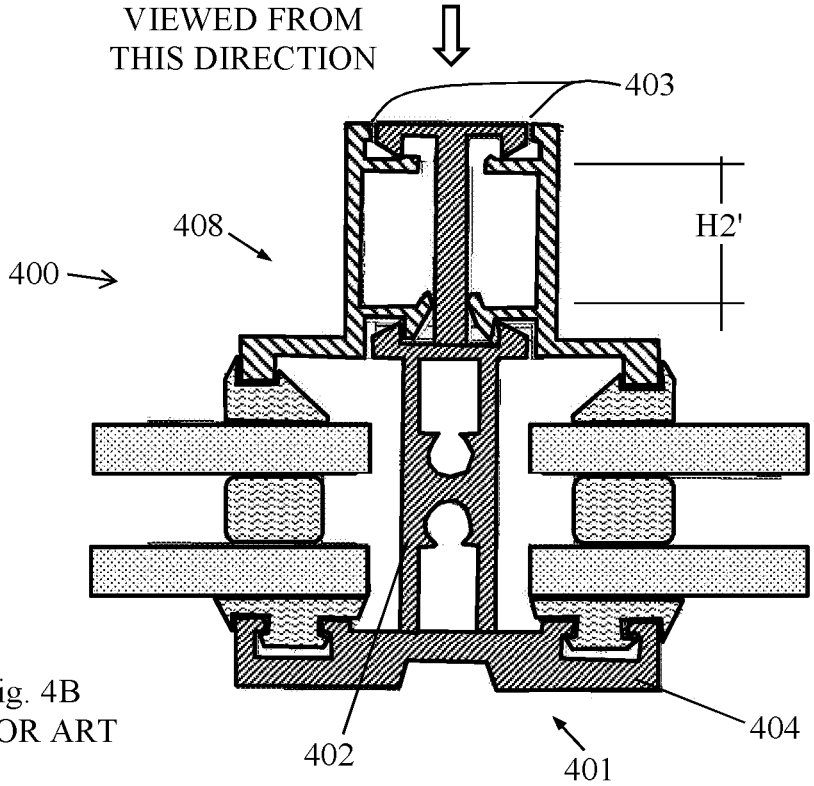
Fig. 4B PRIOR ART
Figure 4C:
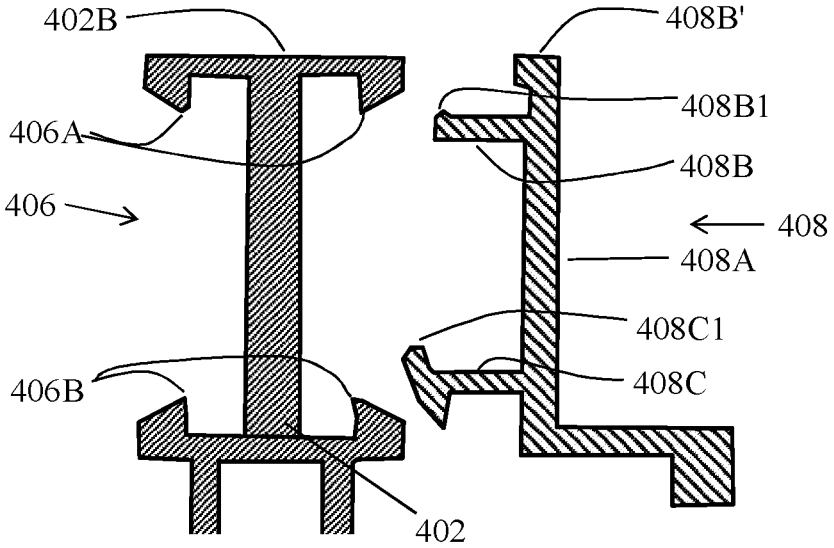
Fig. 4C PRIOR ART
Figure 4D:
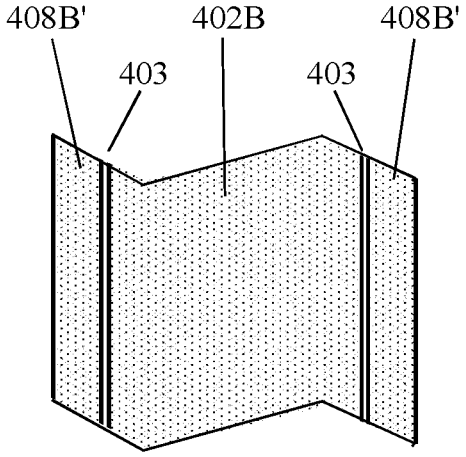
Fig. 4D PRIOR ART
Figure 4E:
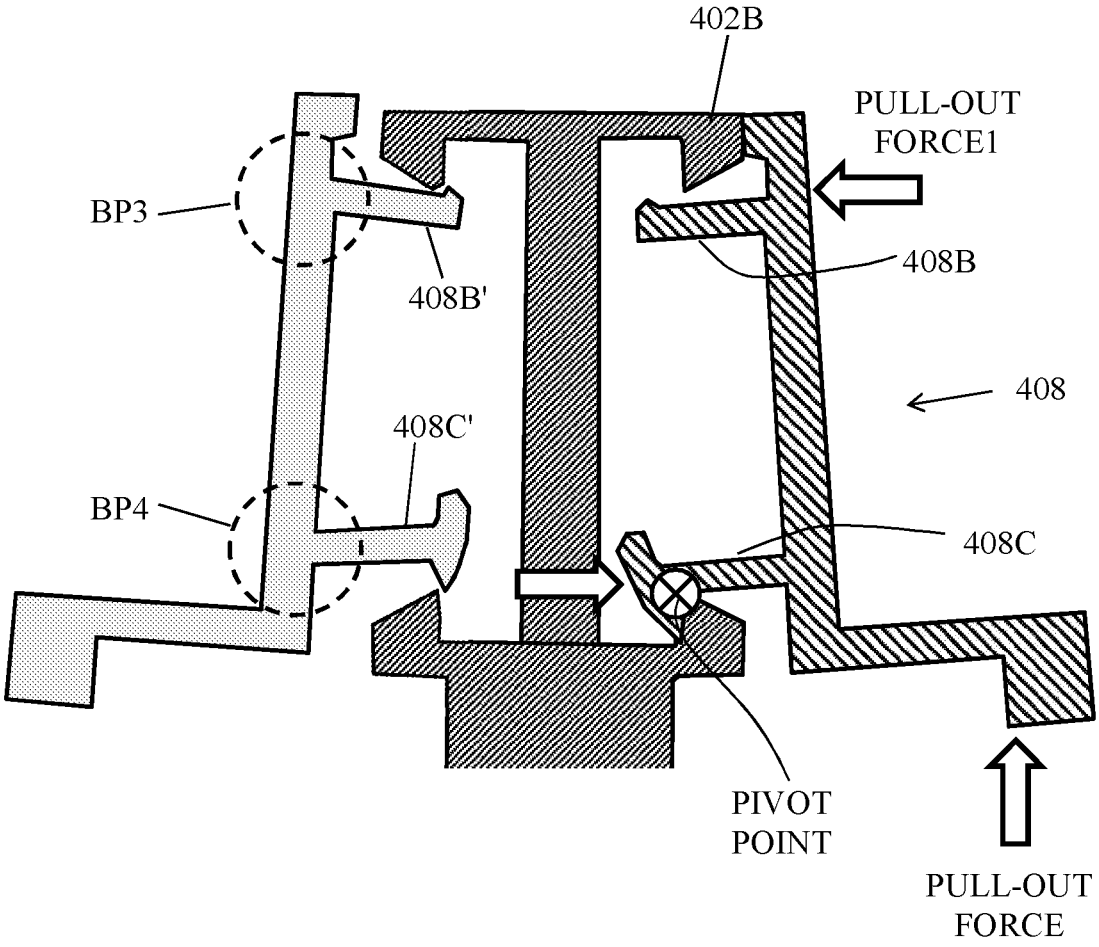
Fig. 4E PRIOR ART
FIG. 4E schematically depicts the result of exertion of "pull-out force" on glazing bar of FIGS. 4A-4D.

Reference is made to FIGS. 4A-4D, which schematically present a perspective view of thin face profile glazing structure 400, a cross section view, a partial disassembled view and a partial top view of this structure, as known in the art. Thin face profile glazing structure 400 is very similar in many aspects to thin face profile glazing structure 300, except for its first installation snap arm 408B and second installation snap arm 408C which are shorter compared to first installation snap arm 308B and second installation snap arm 308C (FIGS. 3A-3D) and compared to distance H2' between first installation snap arm 408B and second installation snap arm 408C. While first installation snap arm 408B and second installation snap arm 408C are shorter, as discussed above, they are still subject to pull-out forces such as force exerted due to fastening force of the glass plates and/or wind force acting on the glass plates. Reference is made now also to FIG. 4E which schematically depicts the result of exertion of "pull-out force" on glazing bar 408. As a result of the action of "pull-out force" about "pivot point" "pull-out force 1" is exerted on the upper lean point 402B of the upper portion of main structure profile 402. As seen in the left side of FIG. 4E, around breaking points BP3 and BP4 first installation snap arm 408B and second installation snap arm 408C tend to bend inwardly as depicted by bent anus 408B' and 408C', respectively.

Thus, both face profile glazing structures 300 and 400 demonstrate disadvantages with respect to sensitivity to pull-out forces and with respect to the decorative appearance of their top view which present, in both structures, visible connection lines 303 and 403, respectively. These disadvantages are addressed in the novel glazing profile of the present invention, as described herein below.

Glazing frame profiles that may provide structural support for glazing of multiple glass layers, to provide enhanced resistibility to forces acting on the glass plates such as wind pressures and concurrently have thin forehead face width is highly advantageous.

In the following description features of glazing frame profiles are described with respect to the form and structural design of the profile's shape of a cross section done in a plane perpendicular to the longitudinal dimension of the profile, assuming that where it is not mentioned otherwise, along the profile the same cross section exists.

Figure 5A:
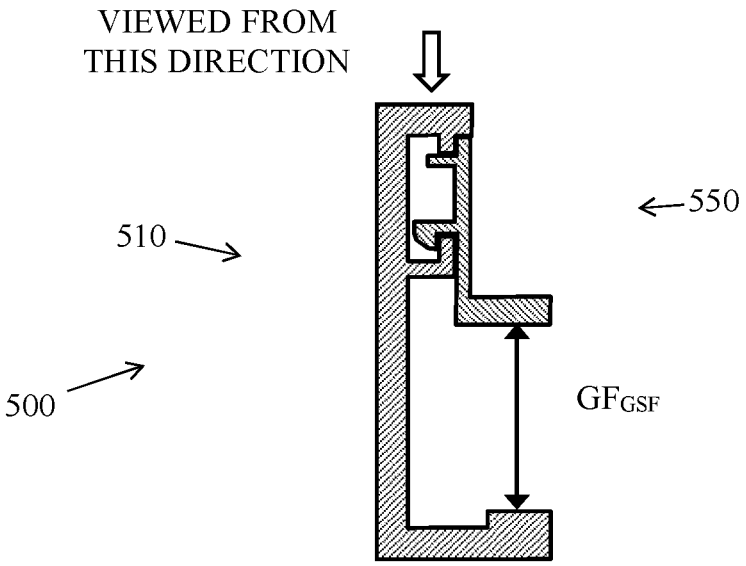
FIG. 5A is a schematic cross section of glazing frame assembly according to embodiments of the present invention.
Figure 5B:
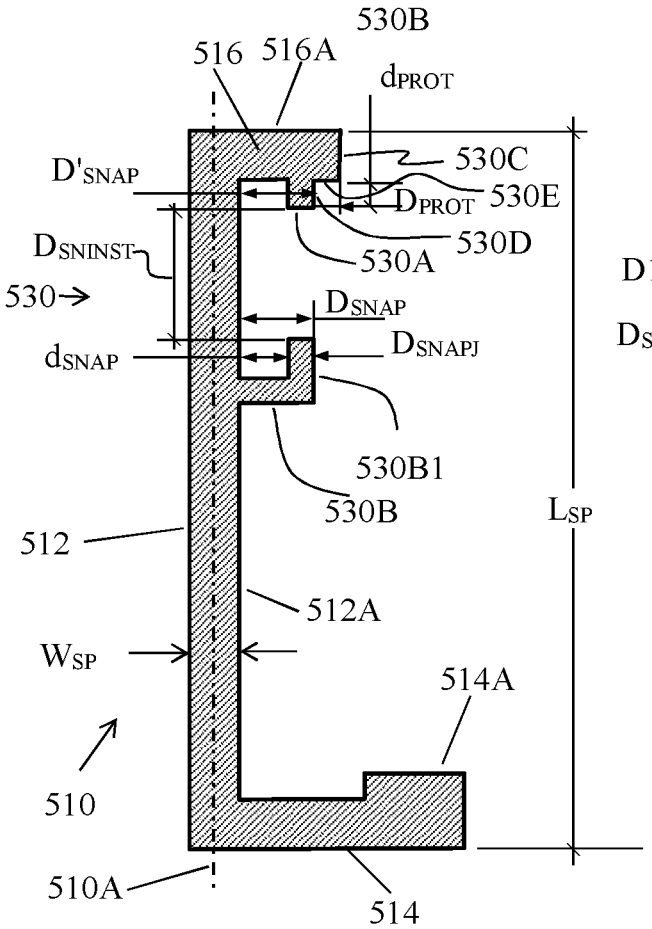
FIGS. 5B and 5C are schematic cross section illustrations of a glazing frame base profile and of glazing bar profile, respectively, according to embodiments of the present invention.
Figure 5C:
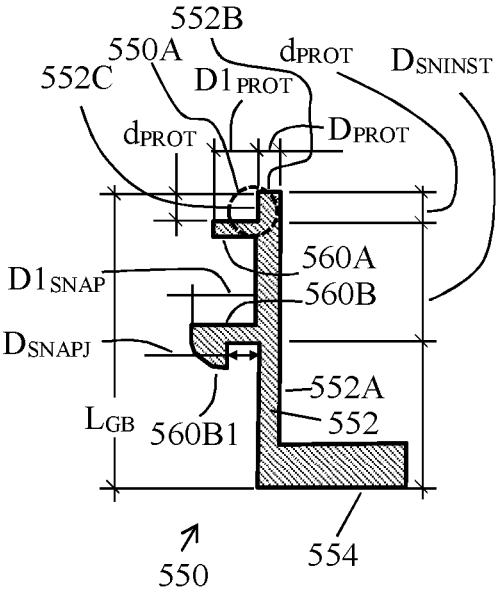

Reference is made to FIG. 5A which is a schematic cross section of glazing frame assembly 500 and to FIGS. 5B and 5C which are schematic cross section illustrations of glazing frame base profile 510 and of glazing bar profile 550, respectively, according to embodiments of the present invention. Glazing frame assembly 500 may be used for framing one or more glass plates (singe, double, triple glazing etc.). Glazing frame assembly 500 may be formed for framing or supporting glass plate(s) at one of its sides or at both sides of the frame profile (glazing partition). Glazing frame assembly 500 of FIG. 5A, and glazing frame base profile 510 are drawn according to according to single side glazing embodiment, however it would be apparent to those skilled in the art that same or similar form of the respective elements of glazing frame base profile 510 appearing on its right side (as in FIG. 5B) may appear, with the required changes made to meet specific framing requirements, on the other side (the left side in FIG. 5B) of glazing frame base profile 510. Moreover, glazing frame base profile 510 may be formed slightly differently from the base form depicted in FIGS. 5A and 5B, yet such additional forms do not deviate from the scope of the invention as described and claimed in the current application.

Glazing flame assembly 500, as depicted in FIG. 5A, is shown in its assembled form, presented using a single-sided frame profile. As seen in the drawing, glazing bar profile 550 is assembled onto glazing flame base profile 510, as is the case when used for glazing, however the glass plates and related elements are removed from this drawing for the sake of improved clarity.

Reference is made now to FIG. 5B, which is a schematic cross section illustration of glazing frame base profile 510, according to embodiments of the present invention. Glazing frame base profile 510 comprise spinal element 512 connected firmly at its first end (herein after "bottom end") to glass support element 514 and have disposed at its second end (herein after "top end") glazing bar connection unit 530. Spinal element 512 is formed as an elongated thin profile aligned with longitudinal line 510A in which the ratio between the thickness $W_{SP}$ of at least portion and its length $L_{SP}$ maintains:

$$\frac{W_{SP}}{L_{SP}} = K_{[k1<K<k2]} \tag{1}$$

Where k1 and k2 define upper and lower limits for the thickness-to-length aspect ratio of glazing frame base profile 510. It would be apparent that the thickness of glazing frame base profile 510 at certain points along it may vary yet, the thickness $W_{SP}$ that is measured at its minimal thickness point(s), defines its points of minimal support strength to forces acting between glass support element 514 and glazing bar profile 550, as indicated by arrow $GF_{GSF}$ (Glazing Frame glazing support force) in FIG. 5A.

Glass support element 514 may be connected, at its proximal end, to glazing frame base profile 510 at its bottom end or close to it, and may extend substantially at a right angle with respect to glazing frame base profile 510 longitudinal line 510A. Glass support element 514 may have provided, at its distal end, glass support pad 514A, which may be adapted to interface a first side of a glazing glass assembly, either in direct contact with the glass assembly or via interface element, as is described herein after.

Glazing bar connection unit 530 may comprise snap support arm 530B extending substantially at a right angle from spinal element 512 to the same side as glass support element 514 to a distance $D_{SNAP}$ of its outer face from spinal element 512, forming gap of $d_{SNAP}$ between its inner face and spinal element 512. At the distal end of snap support arm 530B snap jag 530B1 is disposed extending from the remote end of snap support arm 530B towards the top end 516 of spinal element 512. Snap jag 530B1 is formed as a protrusion from the distal end of snap support arm 530B, so as to provide snap connection for glazing bar 550, as is described herein after.

Glazing bar connection unit 530 may further comprise glazing bar lean support jag 530A extending from top end 516 of spinal element 512 towards snap jag 530B1 and disposed with its outer face at a distance $D'_{SNAP}$ from spinal element 512. According to some embodiments $D'_{SNAP}$ may equal to $D_{SNAP}$, however in all embodiments the magnitude of $D_{SNAP}$ and of $D'_{SNAP}$ is set to enable a required placement of glazing bar profile 550 with respect to glazing frame base profile 510. Typically and preferably glazing bar profile 550 is placed, when snapped onto glazing frame base profile 510, so that the outer face 552A of glazing bar 550 is aligned parallel to longitudinal line 510A of glazing frame base profile 510. It will be noted that the structural dimensions $D_{SNAP}$ and $D'_{SNAP}$ are presented here measured from face 512A of spinal element 512 which in FIG. 5B is presented as a straight line, for the sake of convenience and clarity of the structural features. It will be noted however that these dimensions may be measured from a different reference line, for example from longitudinal line 510A, with the required change in their magnitude.

Top end 516 may extend beyond glazing bar lean support jag 530A by $D_{PROT}$ distance. This dimension may be adapted to fully cover and 'hide' from a viewer the thin face 552B of glazing bar 550 facing away from the glass plates, when glazing bar is assembled with glass plates onto glazing frame base profile 510 and the viewer is looking at the glazed glass plates from the side close to top end 516.

Lean support jag 530A protrudes from the inner face of top end 516A by $d_{PROT}$. This dimension may be set to satisfy selectable design requirements, yet it may be limited at least by the length beyond which the distance $D_{SNINST}$ between the remote end of lean support jag 530A and the remote end of snap jag 530B1 will be considered too short to ensure firm hold of glazing bar profile 550 onto glazing frame base profile 510, as is described in details herein below.

Glazing bar profile 550 may comprise glass fastening bar 554 extending from first (bottom) end of bar spinal element 552 substantially in a right angle toward first side (the outer face of glazing bar profile 550) of bar spinal element 552 and firmly attached to it. According to some embodiments fastening bar 554 may be made as one part with bar spinal element 552. Bar spinal element may be formed as thin elongated element extending longitudinally from glass fastening bar 554 to top end face 552B. Glass fastening bar 554 may have thickness dimension that allows exertion of fastening forces onto glass plates, when glazing frame assembly 500 is assembled with glass plates, as may be required.

Glazing bar 550 may further comprise snap lean protrusion 560A extending substantially at a right angle from bar spinal element 552 from the side of bar spinal element 550 opposite to the side to which glass fastening bar 554 extends. Snap lean protrusion 560A is positioned along bar spinal element 552 at a distance $d_{PROT}$ from top end face 552B of bar spinal element 552. Lean protrusion 560A may protrude from bar spinal element 552 not more than $D_{SNAP}$ thus ensuring that lean protrusion 560A will not touch face 512A of spinal element 512, when glazing bar 550 is assembled onto glazing frame assembly 500.

Glazing bar 550 may further comprise snap hook element 560B extending from bar spinal element 552 from the side of snap lean protrusion 560A, at a point along bar spinal element 550 between snap lean protrusion 560A and fastening bar 554. Snap hook element 560B is formed as a hook the pointed end 560B1 of which points towards the edge of bar spinal element 552 that is close to glass fastening bar 554. The side of pointed end 560B1 of snap hook element 560B that faces bar spinal element 552 is remote from bar spinal element 552 by $D_{SNAPJ}$ which maintains:

$$D_{SNAPJ}=D_{SNAP}-d_{SNAP}$$

This relation between these structural dimensions ensures that when glazing bar 550 is assembled onto glazing frame assembly 500, pointed end 560B1 of snap hook element 560B snaps-slides over the tip 530B1 of snap support arm 530B and tightly embraces it to provide snap-activated fastening of glazing bar 550 to glazing frame assembly 500. At this position distal end 552C of bar spinal element 552 that is close to end face 552B leans against facet 530D of lean support jag 530A of glazing frame base profile 510 and thereby provides counter force to resist turning moment stress exerted when glazing bar 550 exerts fastening force onto the glass plates. Moreover, in this position top end face 552B of glazing bar 550 abuts facet 530E of the portion of top end 516 that protrudes beyond lean support jag 530A. When excessive force is exerted on fastening bar 554 of glazing bar 550, for example due to excessive wind force acting on the glass plates framed in glazing frame assembly 500, snap hook element 560B may tend to bend so that pointed end 560B1 of snap hook element 560B begins sliding off tip 530B1 of snap support arm 530B, this tendency is strongly resisted, and thereby conter-supported due to the counter force provided by facet 530E to top end face 552B of glazing bar 550.

Figure 5D:
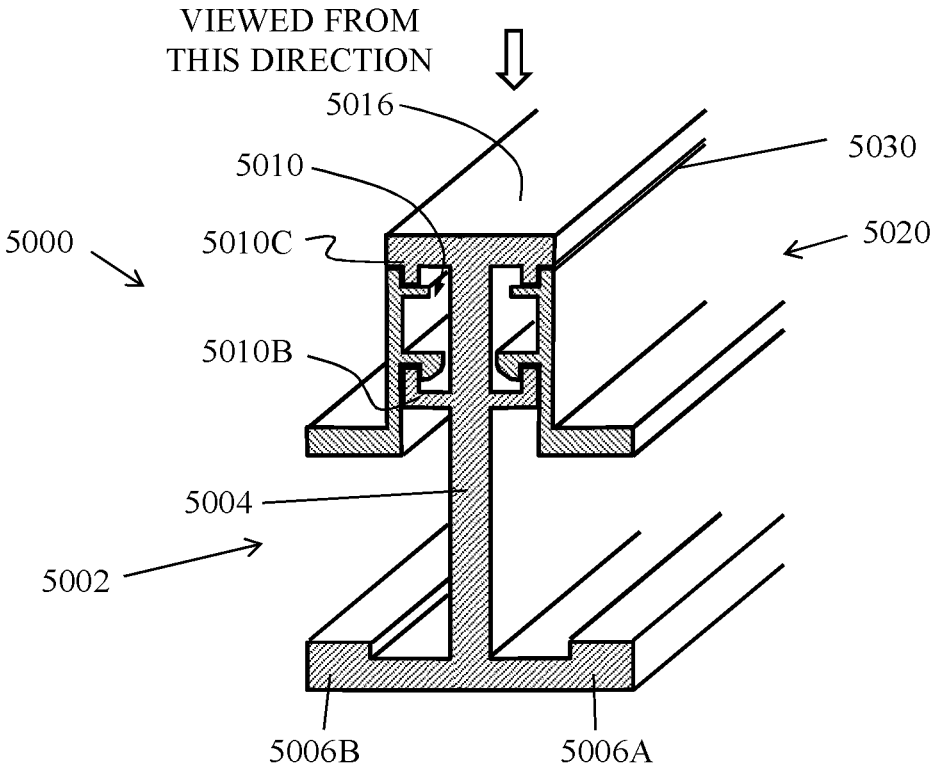
FIGS. 5D and 5E are schematic illustrations of a two-sided glazing frame assembly in isometric view and top partial view, respectively, according to embodiments of the present invention.
Figure 5E:
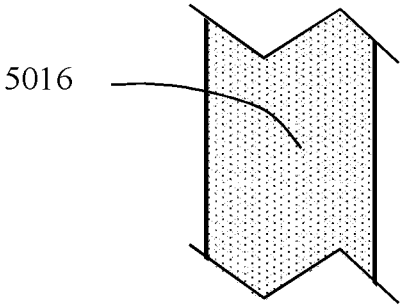

The inventive structure as described with respect to FIGS. 5A-5C may be implemented to provide support to glazing on both sides of the glazing profile. Reference is made now to FIGS. 5D and 5E which are schematic illustrations of a two-sided glazing frame assembly 5000 in isometric view and top partial view, respectively, according to embodiments of the present invention. Glazing frame assembly 5000 comprises a central glazing frame base profile 5002, adapted to accommodate one glazing bar 5020 on each side of it, according to embodiments of the present invention. The general structure of glazing frame assembly 5000 is similar to that of glazing frame assembly 500 of FIGS. 5A-5C, with the necessary modifications. On each side of the two sides of spinal element 5004 there are disposed glazing bar connection units 5010C substantially formed and functioning similar to glazing bar connection units 530 of FIGS. 5A-5C. Glazing bar connection units 5010C are adapted to snap-connect to glazing bar profiles 5020, substantially similar to the snap-connection of glazing bar profile 550 to glazing frame base profile 510. As may be seen, from top-view (as indicated by an arrow in FIG. 5D) the seeable portion 5016 of two-sided glazing frame assembly 5000 is a single flat 'strip' with no seeable connection lines of two adjacent profiles, as opposed to seeable connection lines 403 in FIGS. 4B and 4D. According to the inventive structure of glazing frame assembly 5000 the connection line 5030 formed at the meeting line of the corresponding edges of top element 5010C with top line of the bar spinal element of glazing bar profile 5020. This way the glazing structure provided by glazing frame assembly 5000 provides glazing frame with neat and clean face, having no seeable connection lines.

It will be apparent to those skilled in the art that a glazing frame assembly made according to embodiments of the present invention may have made, one of its sides (left or right) glazing elements as described with respect to FIGS. 5A-5C and any other profile structure on its other side. The profile of that other side may be made to accommodate connection to a wall, to provide support to hinges of a window or a door, etc.

It will also be apparent to those skilled in the art that the longitudinal element, such as spinal element 512 of FIGS. 5A-5C, which connects glass support element, such as element 514 of FIGS. 5A-5C, to glazing bar connection unit, such as connection unit 530 of FIGS. 5A-5C, may be configured n various configurations that may be dictated according to various structural constrains, without departing from the spirit of the invention.

Figure 5F:
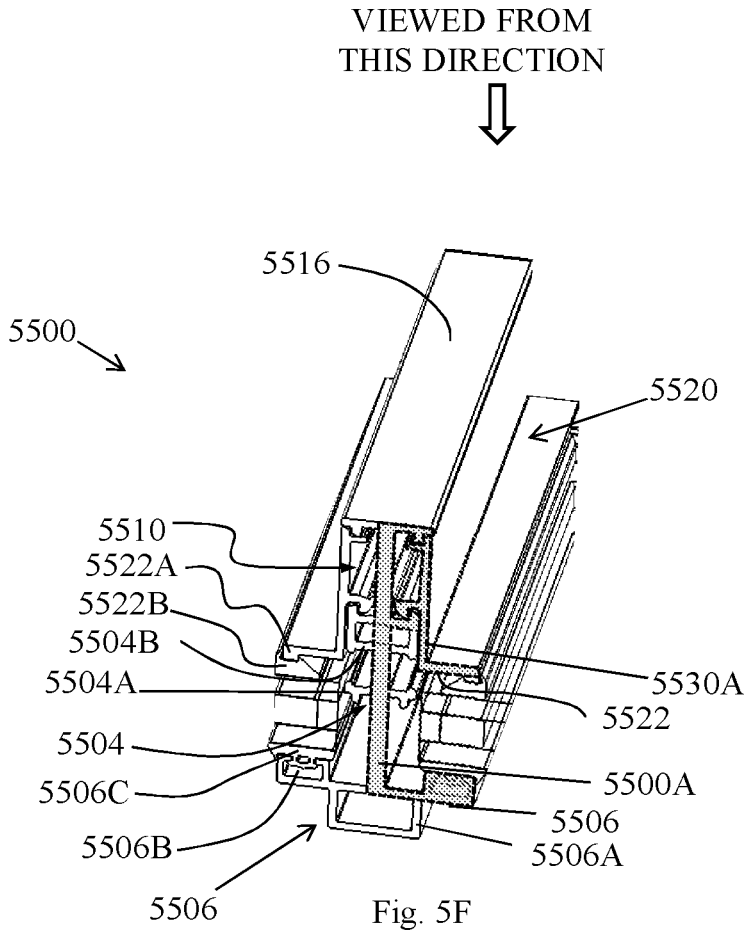
FIGS. 5F and 5G, which are schematic illustrations of a two-sided glazing frame assembly in isometric view and top partial view, respectively, according to embodiments of the present invention.
Figure 5G:
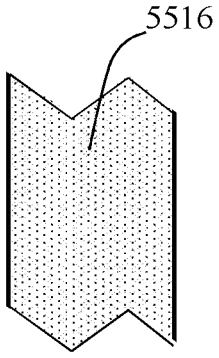

Reference is made now to FIGS. 5F and 5G, which are schematic illustrations of a two-sided glazing frame assembly 5500 in isometric view and top partial view, respectively, according to embodiments of the present invention. The similarity of the structure of glazing frame assembly 5500 to glazing frame assembly 500 of FIGS. 5A-5C is emphasized by the grey-shapes 5500A and 5550A which are similar to glazing frame base profile 510 and glazing bar profile 550, respectively. In the embodiment of glazing frame assembly 5500 some modifications were made/added, such as bottom box 5506A disposed underneath glass support element 5506, installation internal profile 5504 or snap support arm strengthening structure 5504B, however these modifications/additions do not depart from the spirit of the basic structural form of glazing frame assembly according to embodiments of the present invention, such as glazing frame assembly 500 or 5000. As clearly seen in FIG. 5G, from top view the seeable form of top end of 5516 of glazing frame assembly 5000 is a single longitudinal stripe with no seeable connections lines.

Glazing frame assembly 5500 further comprises glazing bar 5520 which substantially is formed similar to glazing bar 5020.

According to some embodiments glazing frame assembly 5500 may further comprise glass pad installation channel 5506B disposed on glass support portion 5506 so that its open face is facing towards top face 5516 of installation internal profile 5504. installation channel 5506B is formed to accommodate glass pad 5506C that has a substantially flat face facing towards top face 5516 so as to provide fastening area to a fastened glass. Glass pad 5506C may preferably be made of a material having certain degree of flexibility to allow providing fastening force to a glass plate without breaking it.

Glazing bar 5520 further comprises glass upper pad support element 5522A disposed substantially at the distal end of glass fastening bar 5522. Pad support element 5522A may be formed as an elongated protrusion with thickening at its head end, adapted to allow snap-connection of glass top fastener pad 5522B. Glass top fastener pad 5522B has a substantially flat face facing towards pad 5506C so as to provide fastening area to a fastened glass. Glass top fastener pad 5522B may preferably be made of a material having certain degree of flexibility to allow providing fastening force to a glass plate without breaking it Reference is made now to FIGS. 6A and 6B which are schematic illustrations of glazing frame assembly 600 according to some embodiments of the present invention.

Figures 6A, 6B:
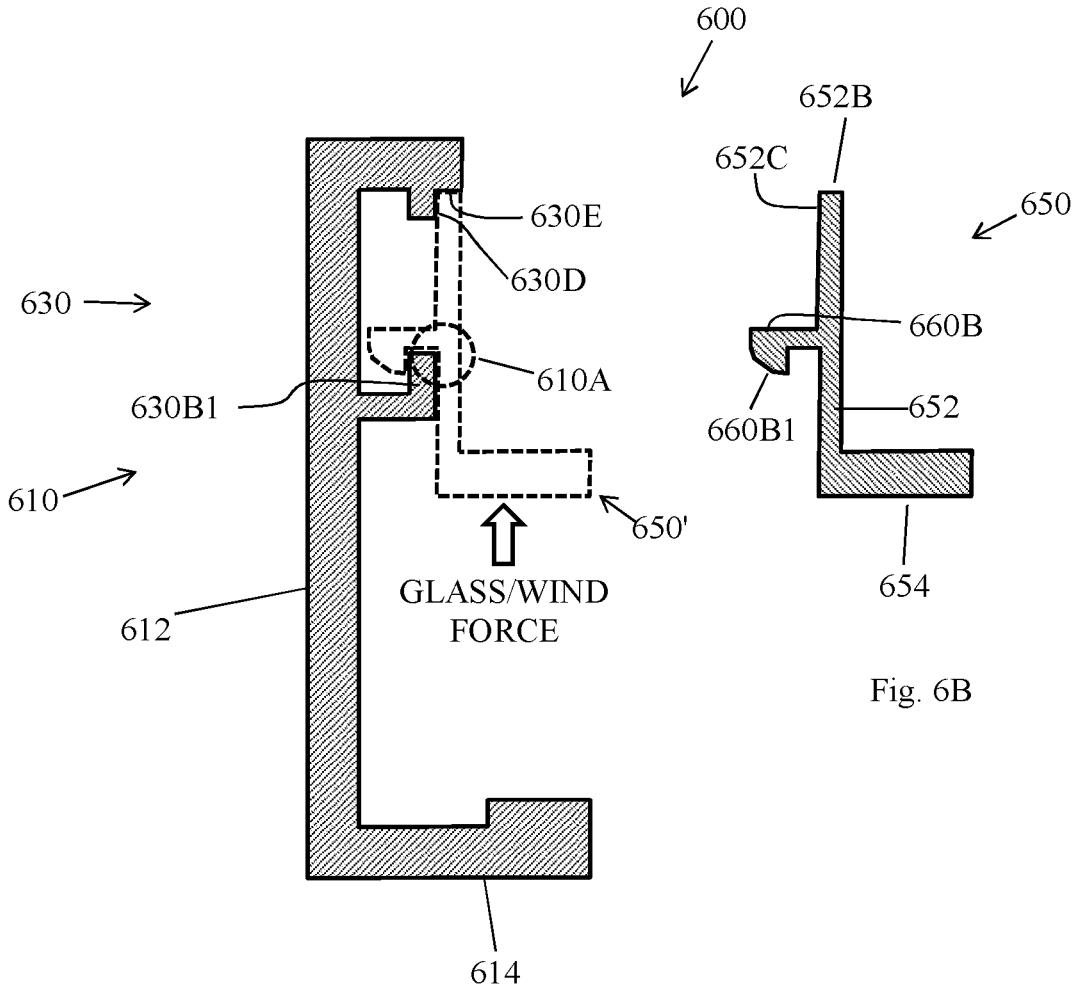
FIGS. 6A and 6B are schematic illustrations of a glazing flame assembly according to some embodiments of the present invention.

Glazing frame assembly 600 comprise glazing frame base profile 610 and glazing bar profile 650 that is adapted to snap-connect to glazing frame base profile 610, as is exemplified by dashed-line glazing bar profile 650' in FIG. 6A. Glazing frame base profile 610 is substantially same as glazing frame base profile 510 of FIGS. 5A-5C and the description of the various elements of glazing frame base profile 510 is applicable with respect to glazing frame base profile 610. Glazing bar profile 650 differs from glazing bar 550 by not having disposed on it a snap lean protrusion, such as snap lean protrusion 560A of FIG. 5C. When glazing bar profile 650 is snapped onto glazing frame base profile 610 and forces, such as glazing force and/or wind force are exerted onto glass fastening bar 654 as is exemplified by the arrow, moments develop around pivot point 610A formed by the snap connection of snap hook element 660B and snap jag 630B1. Counter moment force is provided by facet 630D that acts against distal end 652C of bar spinal element 652 and of glazing bar profile 650 and counter force that resists pull-out of glazing bar profile 650 from the snap-connection to glazing frame base profile 610 is provided by the counter force that facet 630E provides to thin face 652B of glazing bar profile 650. The embodiment depicted in FIGS. 6A and 6B may solve practical issues that arise, in certain cases, with glazing bars formed as glazing bar 550 of FIGS. 5A-5C. When such glazing bar is painted, even using thin coating provided by spray painting, thicker layer of pain tends to build-up in the corner marked 550A in FIG. 5C. Such build-up sometimes prevents proper installation of glazing bar such as glazing bar 550, onto its corresponding glazing frame base profile, such as glazing frame base profile 510. When this is the case it may not be solved easily, or may not be solved at all, without harming the paint coating of the glazing bar.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A glazing frame assembly (500) comprising:

a glazing frame base profile (510), a cross section of same comprising:

an elongated spinal element (512);

a glass support element (514) with a glass support pad (514A) formed on the end distal from the elongated spinal element; and glazing bar connection unit (530), comprising:

a snap support arm (530B);

a lean support jag (530A); and a top end (516) of said elongated spinal element; and a glazing bar profile (550), the cross section of same comprising:

a bar spinal element (552);

a glass fastening bar (554) extending from first (bottom) end of bar spinal element (552);

a snap hook element (560B); and a snap lean protrusion (560A) positioned along the bar spinal element at a distance ($d_{PROT}$) from a top end face (552B) of the bar spinal element;

wherein, when the glass support element (514) and the glazing bar connection unit (530) are connected, said glass support pad (514A) and said glass fastening bar (554) are disposed facing each other and are adapted to provide pressure on a glazing plate at a direction aligned with the longitudinal dimension of the elongated spinal element (512);

said top end element (516) protrudes away from said elongated spinal element (512) beyond said lean support jag (530A) by ($D_{PROT}$) length extending at least as the thickness of said bar spinal element (552), thereby forming inner facet (530E), wherein, when said glazing bar element is installed on said glazing frame base profile so that the snap hook element is engaged with the snap support bar top end face (552B) leans against the inner facet, and wherein the line connecting between the snap hook element and the inner facet is substantially perpendicular to the face of the glass support pad.

2. The glazing frame assembly (500) of claim 1 wherein said glazing bar profile (550) further comprising:

a snap lean protrusion (560A).

3. The glazing frame assembly (500) of claim 1 wherein said glazing frame base profile (510) further comprising:

glass pad installation channel (5506B).

4. The glazing frame assembly (500) of claim 3 wherein said glazing frame base profile (510) further comprising:

glass pad (5506C) adapted to be installed into said glass pad installation channel (5506B) and to provide contact area for exerting fastening force onto a glass plate.

5. A glazing frame assembly (500) comprising:

a glazing frame base profile (510), a cross section of same comprising:

an elongated spinal element (512);

a glass support element (514) with a glass support pad (514A) formed on the end distal from the elongated spinal element; and glazing bar connection unit (530), comprising:

a snap support arm (530B);

a lean support jag (530A); and a top end (516) of said elongated spinal element; and a glazing bar profile (550), the cross section of same comprising:

a bar spinal element (552);

a snap hook element (560B)

a snap lean protrusion (560A) positioned along the bar spinal element at a distance ($d_{PROT}$) from a top end face (552B) of the bar spinal element;

wherein, when the glass support element (514) and the glazing bar connection unit (530) are connected, said glass support pad (514A) and said glass fastening bar (554) are disposed facing each other and are adapted to provide pressure on a glazing plate at a direction aligned with the longitudinal dimension of the elongated spinal element (512);

wherein said top end element (516) protrudes away from said elongated spinal element (512) beyond said lean support jag (530A) by ($D_{PROT}$) length extending at least as the thickness of said bar spinal element (552), thereby forming inner facet (530E), wherein, when said glazing bar element is installed on said glazing frame base profile so that the snap hook element is engaged with the snap support bar top end face (552B) leans against the inner facet, and wherein the line connecting between the snap hook element and the inner facet is substantially perpendicular to the face of the glass support pad.

6. The glazing frame assembly (500) of claim 5 wherein said glazing frame base profile (510) further comprising:

glass pad installation channel (5506B).

7. The glazing frame assembly (500) of claim 5 wherein said glazing frame base profile (510) further comprising:

glass pad (5506C) adapted to be installed into said glass pad installation channel (5506B) and to provide contact area for exerting fastening force onto a glass plate.

* * * * *